US008161612B2

(12) United States Patent
Jung

(10) Patent No.: US 8,161,612 B2
(45) Date of Patent: Apr. 24, 2012

(54) BROKEN TEE EXTRACTOR

(76) Inventor: Man-Young Jung, Pasadena, CA (US)

( * ) Notice: Subject to any disclaimer, the term of this patent is extended or adjusted under 35 U.S.C. 154(b) by 511 days.

(21) Appl. No.: 12/537,462

(22) Filed: Aug. 7, 2009

(65) Prior Publication Data

US 2011/0030182 A1 Feb. 10, 2011

(51) Int. Cl.

| | |
|---|---|
| ***B25B 27/14*** | (2006.01) |
| ***B23P 19/04*** | (2006.01) |
| ***B25B 1/00*** | (2006.01) |
| ***A63B 55/00*** | (2006.01) |
| ***A63B 53/00*** | (2006.01) |
| *A63B 57/00* | (2006.01) |

(52) U.S. Cl. ..... 29/278; 29/244; 29/248; 29/280; 269/3; 269/6; 473/284; 473/286

(58) Field of Classification Search ..... 29/244–280; 269/3, 6; 473/284, 286, 340
See application file for complete search history.

(56) References Cited

U.S. PATENT DOCUMENTS

| | | | | |
|---|---|---|---|---|
| 4,841,819 | A * | 6/1989 | Williams | 81/3.8 |
| 5,116,046 | A * | 5/1992 | Pace | 473/286 |
| 5,160,134 | A * | 11/1992 | McDonald | 473/406 |
| 5,165,744 | A * | 11/1992 | Vogrin | 294/19.2 |
| 5,267,493 | A * | 12/1993 | Yamagata et al. | 81/3.8 |
| 5,407,194 | A * | 4/1995 | Snow | 473/131 |
| 5,540,432 | A * | 7/1996 | Keller | 473/386 |
| 5,772,533 | A * | 6/1998 | Dahlmann | 473/386 |
| 5,788,197 | A * | 8/1998 | Tutela | 248/156 |
| 5,797,298 | A * | 8/1998 | Grevel | 81/3.8 |
| 5,839,972 | A * | 11/1998 | Swanson | 473/286 |
| 6,033,322 | A * | 3/2000 | England | 473/408 |
| 6,308,934 | B1 * | 10/2001 | Gallo | 254/25 |
| 6,413,173 | B1 * | 7/2002 | Muller et al. | 473/408 |
| 6,514,159 | B2 * | 2/2003 | Hendren | 473/408 |
| 6,645,092 | B1 * | 11/2003 | Hendren | 473/408 |
| 6,878,071 | B1 * | 4/2005 | Schwieger et al. | 473/284 |
| 6,926,622 | B1 * | 8/2005 | Yates | 473/386 |
| 7,086,971 | B2 * | 8/2006 | Zmetra | 473/386 |
| 7,189,166 | B2 * | 3/2007 | Pare | 473/282 |
| D541,610 | S * | 5/2007 | Segroves | D8/51 |
| 7,384,086 | B2 * | 6/2008 | Lukaszynski et al. | 294/99.2 |
| 7,712,199 | B1 * | 5/2010 | Wilson | 29/254 |
| 7,726,713 | B2 * | 6/2010 | Oleksia | 294/24 |
| 7,766,769 | B2 * | 8/2010 | Lueders | 473/408 |
| 7,850,550 | B2 * | 12/2010 | Nania et al. | 473/408 |
| 7,946,010 | B1 * | 5/2011 | Myers et al. | 29/213.1 |
| 2009/0286616 | A1 * | 11/2009 | Stone | 473/286 |
| 2011/0230281 | A1 * | 9/2011 | Carsey | 473/408 |

* cited by examiner

*Primary Examiner* — Lee D Wilson
*Assistant Examiner* — Alvin Grant
(74) *Attorney, Agent, or Firm* — Clement Cheng

(57) ABSTRACT

A broken tee extractor has a bulbous handle portion and a pair of tweezer arms extending downwardly from the bulbous handle portion. A narrow neck extends upwardly from the bulbous handle portion. A platform terminates the narrow neck and is supported by the narrow neck. A tee pulling member is mounted to the platform and a notch is formed between a pair of hook arms. The tee pulling member comprises the pair of hook arms and the notch. The broken tee extractor also has a pair of points disposed on the pair of tweezer arms. The pair of points are oriented inward.

12 Claims, 8 Drawing Sheets

BROKEN TEE EXTRACTOR

BACKGROUND

During a game of golf, golf tees are commonly broken. For removal of golf tees, players typically use their fingers to pick out the golf tee. Unfortunately, using a finger is troublesome.

Devices such as U.S. Pat. No. D362,480 to Reaves issued Sep. 19, 1995 may assist as a Golf Tee Placement and Removal Aid. A variety of devices have been constructed for repairing divots, setting tees, but it is desired to have a device for removal of broken golf tees.

A variety of household tools can be used for retrieving golf tees, however these household tools are not suitable for travel on a golf course. Thus, what is needed is a specialized light-weight broken golf tee remover that is usable by the general playing population.

SUMMARY OF THE INVENTION

The present embodiment of the broken tee extractor has a bulbous handle portion terminating in a pair of tweezer arms. The pair of tweezer arms are optionally made of plastic or metal and have a pair of inward pointing tips. The pair of tweezer arms preferably have a pair of points that point inward which touch each other in the closed position. In open position, the pair of tweezer arms are preferably parallel to each other.

The handle portion has a neck terminating on a platform. The platform supports a tee pulling member which forms a notch between a pair of hook arms. Optionally, the tee pulling member may be mounted on a pivot allowing rotation relative to the platform.

The hook arms can be made as a circular profile pair of arms opposing an abutment extending from an opposite side of the pivot. The circular profile appears as a section of a cylinder from the side view. A single hook arm can also be used for pulling at a golf tee.

The neck preferably has a circular cross-section profile while the handle portion is a more rectangular with a rounded and bulbous profile. A circular cross-section profile would have a symmetry around an axis parallel to the and passing through the handle portion.

The tips preferably extend inward, but can also extend outward. A gap approximately the diameter of the neck and the platform defines the distance between the pair of tweezer arms. The pair of tweezer arms may continue to extend through the handle portion. The pair of tweezer arms may be made of a single piece of metal lodged within handle portion. Handle portion can be made as a hollow rubber sleeve, or a solid elastomeric or plastic molding over the pair of tweezer arms. The handle portion has an extension of a shoulder over the neck to allow a pulling grip when pulling a tee out of the ground. The second embodiment is a lightweight version which does not have a large handle portion with a neck. The second embodiment has long pair of tweezer arms and has a more narrow V shaped gap.

To use the broken tee extractor, a user may use the tweezer arms to grasp at a stem of a golf tee that is embedded in the ground. A user may also use the pair of hook arms for grasping a partially broken head or at a stem of a golf tee that is embedded in the ground. The V shaped notch may also be used for grasping a partially broken golf tee.

Figure 1:
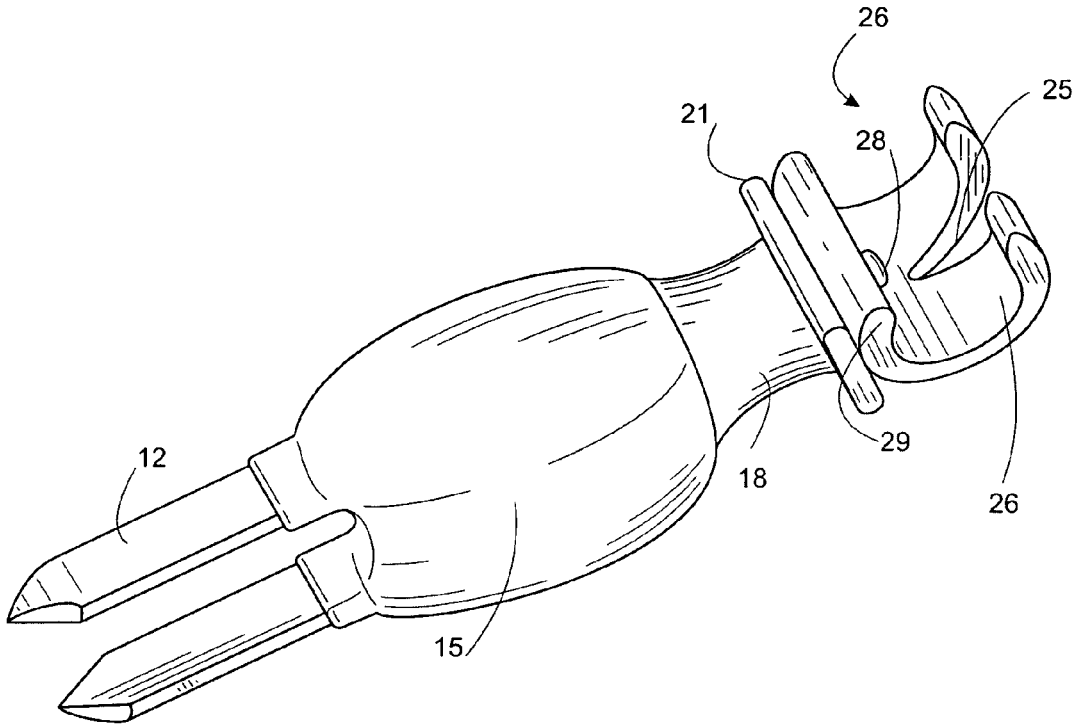
FIG. 1 is a perspective view.
Figure 2:
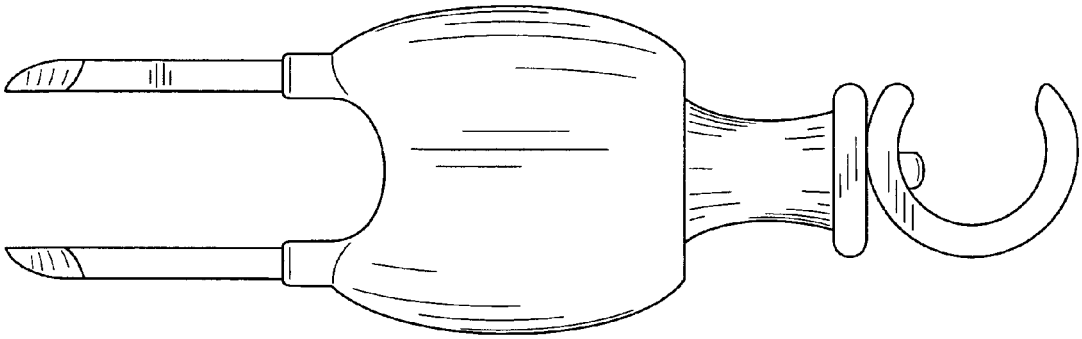
FIG. 2 is a left side view.
Figure 3:
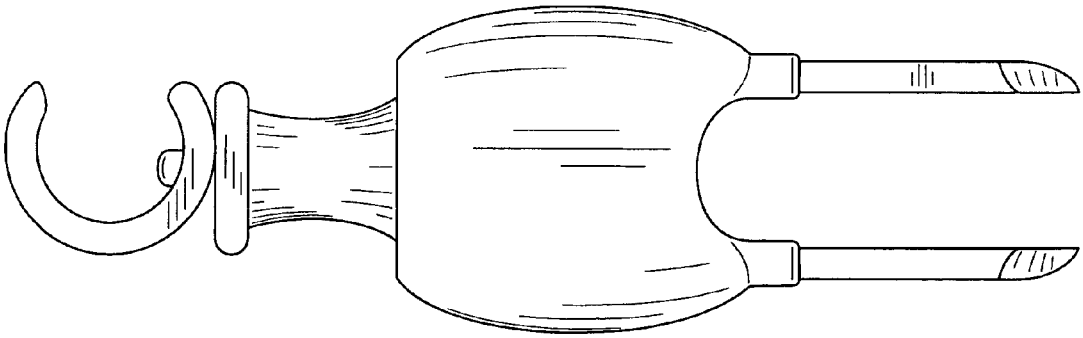
FIG. 3 is a right side view.
Figure 4:
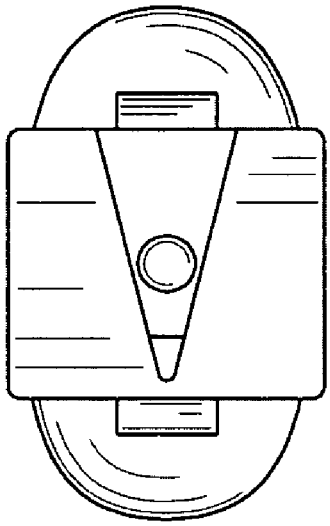
FIG. 4 is a top view.
Figure 5:
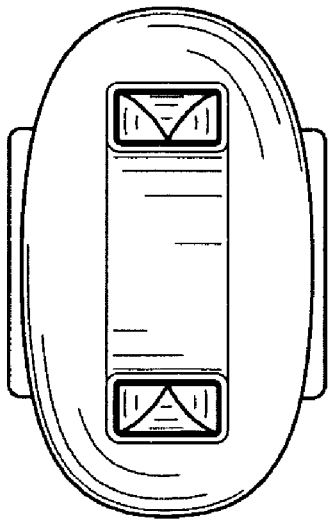
FIG. 5 is a bottom view.
Figure 6:
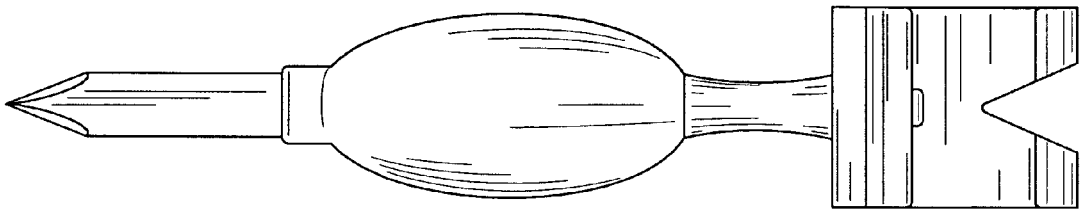
FIG. 6 is a front view.
Figure 7:
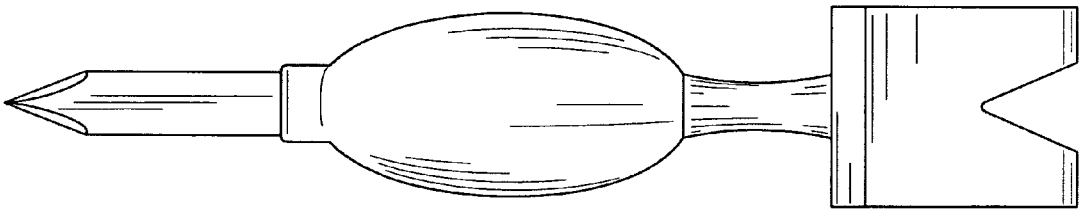
FIG. 7 is a rear view.

The following call a list of elements is used consistently herein for describing the elements of the drawings.

12 tweezer arms
15 handle portion
18 neck
21 platform
22 tee pulling member
25 notch
26 hook arms
28 pivot
29 abutment

DETAILED DESCRIPTION OF THE PREFERRED EMBODIMENT

The present embodiment of the broken tee extractor has a bulbous handle portion 15 terminating in a pair of tweezer arms 12. The pair of tweezer arms are optionally made of plastic or metal and have a pair of inward pointing tips. The pair of tweezer arms preferably have a pair of points that point inward which touch each other in the closed position. In open position, the pair of tweezer arms are preferably parallel to each other.

The handle portion 15 has a neck 18 terminating on a platform 21. The platform supports a tee pulling member 22 which forms a notch 25 between a pair of hook arms 26. Optionally, the tee pulling member 22 may be mounted on a pivot 28 allowing rotation relative to the platform 21.

The hook arms 26 can be made as a circular profile pair of arms opposing an abutment 29 extending from an opposite side of the pivot 28. The circular profile appears as a section of a cylinder from the side view. A single hook arm can also be used for pulling at a golf tee.

The neck preferably has a circular cross-section profile while the handle portion 15 is a more rectangular with a rounded and bulbous profile. A circular cross-section profile would have a symmetry around an axis parallel to the and passing through the handle portion.

Figure 8:
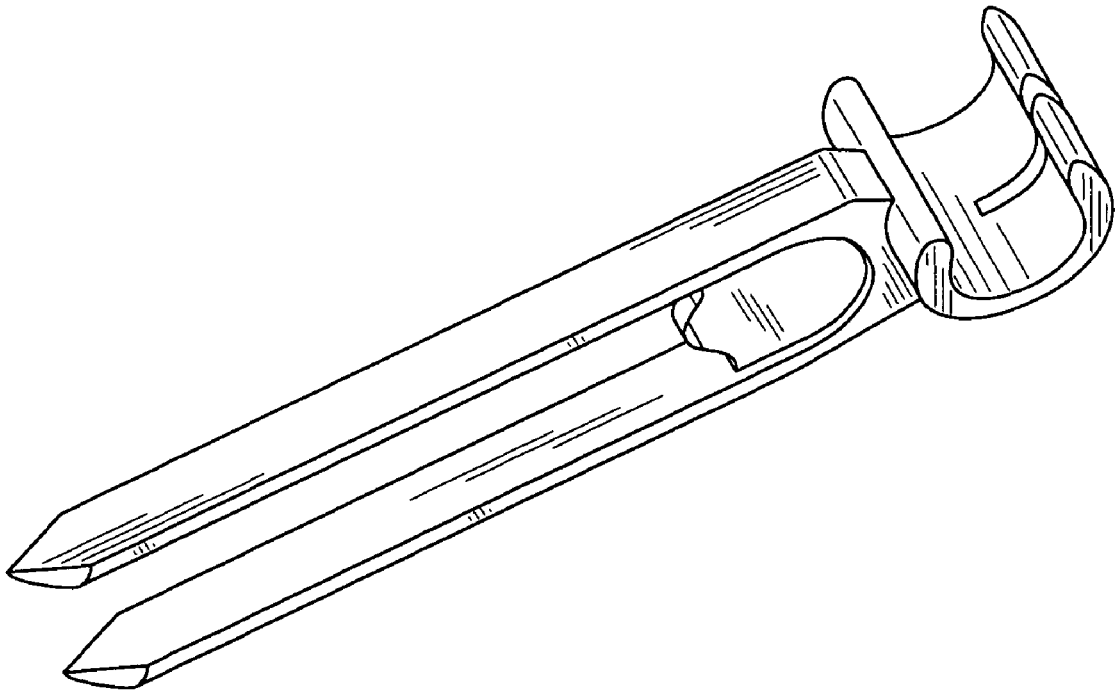
FIG. 8 is a perspective view of the second embodiment.
Figure 9:
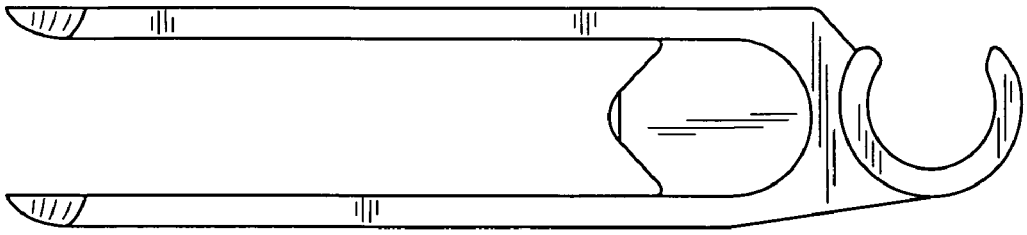
FIG. 9 is a left side view of the second embodiment.
Figure 10:
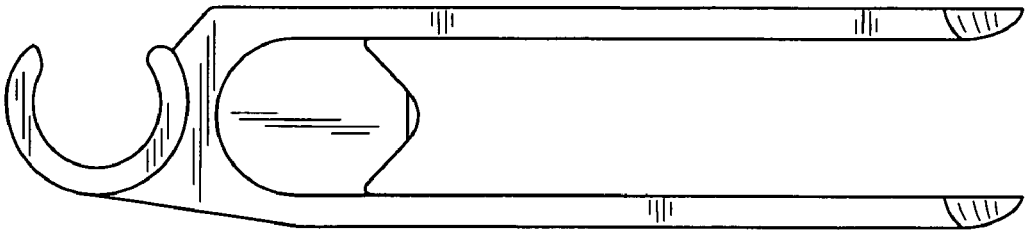
FIG. 10 is a right side view of the second embodiment.
Figure 11:
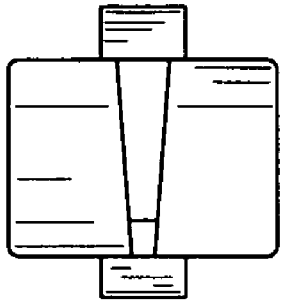
FIG. 11 is a top view of the second embodiment.
Figure 12:
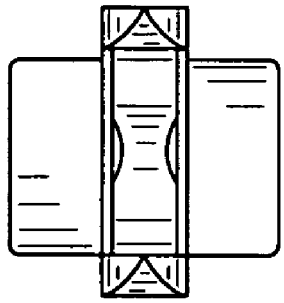
FIG. 12 is a bottom view of the second embodiment.
Figure 13:
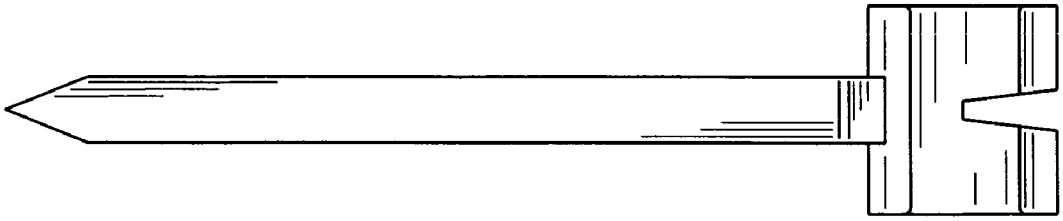
FIG. 13 is a front view of the second embodiment.
Figure 14:
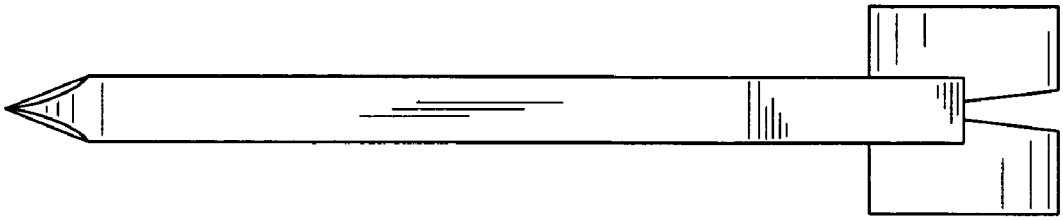
FIG. 14 is a rear view of the second embodiment.

The tips preferably extend inward, but can also extend outward. A gap approximately the diameter of the neck and the platform defines the distance between the pair of tweezer arms. The pair of tweezer arms may continue to extend through the handle portion 15. The pair of tweezer arms may be made of a single piece of metal lodged within handle portion 15. Handle portion 15 can be made as a hollow rubber sleeve, or a solid elastomeric or plastic molding over the pair of tweezer arms. The handle portion 15 has an extension of a shoulder over the neck 18 to allow a pulling grip when pulling a tee out of the ground. The second embodiment as shown in FIGS. 8-14 is a lightweight version which does not have a large handle portion with a neck. The second embodiment has long pair of tweezer arms and has a more narrow V shaped gap.

To use the broken tee extractor, a user may use the tweezer arms to grasp at a stem of a golf tee that is embedded in the ground. A user may also use the pair of hook arms for grasping a partially broken head or at a stem of a golf tee that is embedded in the ground. The V shaped notch may also be used for grasping a partially broken golf tee.

The invention claimed is:

1. A broken tee extractor comprising:

a. a bulbous handle portion;

b. a pair of tweezer arms extending downwardly from the bulbous handle portion;

c. a narrow neck extending upwardly from the bulbous handle portion;

d. a platform terminating the narrow neck and supported by the narrow neck;

e. a tee pulling member mounted to the platform;

f. a notch formed between a pair of hook arms, wherein the tee pulling member comprises the pair of hook arms and the notch.

2. The broken tee extractor of claim 1, further comprising: a pair of points disposed on the pair of tweezer arms, wherein the pair of points are oriented inward, further comprising a pivot connection between the pair of hook arms and the narrow neck.

3. The broken tee extractor of claim 1, wherein the narrow neck has a circular cross-section profile.

4. The broken tee extractor of claim 3, further comprising: a pair of points disposed on the pair of tweezer arms, wherein the pair of points are oriented inward.

5. The broken tee extractor of claim 3, further comprising: an abutment opposing the pair of hook arms.

6. The broken tee extractor of claim 1, further comprising: an abutment opposing the pair of hook arms.

7. The broken tee extractor of claim 1, wherein the notch formed between a pair of hook arms is a V shape, further comprising a pivot connection between the pair of hook arms and the narrow neck.

8. The broken tee extractor of claim 7, further comprising: a pair of points disposed on the pair of tweezer arms, wherein the pair of points are oriented inward, wherein the pair of points touch in a closed position.

9. The broken tee extractor of claim 8, wherein the narrow neck has a circular cross-section profile.

10. The broken tee extractor of claim 9, further comprising: a pair of points disposed on the pair of tweezer arms, wherein the pair of points are oriented inward.

11. The broken tee extractor of claim 9, further comprising: an abutment opposing the pair of hook arms.

12. The broken tee extractor of claim 7, further comprising: an abutment opposing the pair of hook arms.

* * * * *